United States Patent [19]

Chollet

[11] Patent Number: 5,065,914

[45] Date of Patent: Nov. 19, 1991

[54] ONE-PIECE CONTAINER WITH A POURING TUBE, MADE FROM A THERMOPLASTIC MATERIAL

[75] Inventor: Jean-Louis Chollet, Lyons, France

[73] Assignee: Etablissements Marius Millet & Cie, Pratz, France

[21] Appl. No.: 545,828

[22] Filed: Jun. 29, 1990

[30] Foreign Application Priority Data

Jun. 30, 1989 [FR] France ..... 89 09446

[51] Int. Cl.[5] ..... B67D 3/00

[52] U.S. Cl. ..... 222/529; 222/530; 222/531; 222/572

[58] Field of Search ..... 222/527-531, 222/538, 566, 572, 574; 220/855 P; 251/4, 149.8, 349; 272/533, 536

[56] References Cited

U.S. PATENT DOCUMENTS

| | | | |
|---|---|---|---|
| 3,323,694 | 6/1967 | Stevens, Jr. | 222/530 |
| 3,907,179 | 9/1975 | Pehr et al. | 222/538 |
| 4,453,653 | 6/1984 | Chapelsky et al. | 222/530 |
| 4,572,412 | 2/1986 | Brach et al. | 222/574 |

FOREIGN PATENT DOCUMENTS

| | | | |
|---|---|---|---|
| 3104561 | 8/1982 | Fed. Rep. of Germany . | |
| 1215061 | 4/1960 | France | 222/530 |
| 1227631 | 8/1960 | France | 222/530 |
| 2492769 | 4/1982 | France . | |
| 2098184 | 11/1982 | United Kingdom | 222/530 |

*Primary Examiner*—Kevin P. Shaver
*Assistant Examiner*—Philippe Derakshani
*Attorney, Agent, or Firm*—Oliff & Berridge

[57] ABSTRACT

A thermoplastic container molded in a single piece includes a storing body and a pouring tube. A pivoting means or hinge for the tube is obtained by the formation of two recessed pyramids on two lateral walls such that the pivoting of the tube takes place by inner surfaces, which are incorporated in the break in the articulation, folding up flat.

14 Claims, 2 Drawing Sheets

ONE-PIECE CONTAINER WITH A POURING TUBE, MADE FROM A THERMOPLASTIC MATERIAL

TECHNICAL FIELD

The present invention relates to a container of the can type made in a single piece by molding of a thermoplastic material, and comprising an integrated pouring tube. Such a container may be used in relation to a motor vehicle, for containing motor fuel, lubricating oil, antifreeze, brake fluid, etc.

BACKGROUND

According to the document FR-A-2,492,769, a container of the abovementioned type has been described comprising a hollow parallelepipedal body intended to store a fluid, and a pouring tube connected to said body by its upper face and on the side of its front face. This pouring tube incorporates, at the level at which it joins the storing body, a pivoting or articulation means consisting of a series of outer annular grooves centered on the axis of the tube and forming a bellows. This pivoting means enables the tube to be articulated between a stored position, folded down against the top wall of the storing body and as it were within the volume of the container, and a use position, corresponding to the molding position, in which said tube is raised by approximately 90° relative to the stored position.

Such containers prove to be inconvenient to use. Indeed, when the liquid is being poured, the tube must be held constantly with one hand in order to prevent its sudden and unexpected elastic return in the event of a wrong movement. Such an elastic return may have unpleasant consequences for the user, as may be readily imagined when the product contained is oil or any soiling or corrosive product.

The document DE-A-3,104,561 describes a cap with a pouring spout which is made as a single piece from a thermoplastic material and is suited more particularly to disposable plastic containers. The pouring spout forms, together with the rest of the cap, a means for pivoting between a closed position, folded down into a corresponding housing of the cap, and a use position, corresponding to the molding position, in which the pouring spout is raised angularly by approximately 90° relative to said closed position. According to this document, the pouring spout has two lateral faces facing each other and separated by two faces, one straight and inside in the closing direction, and the other convex and outside in the closing direction. The pivoting means has, on the outer side, a plastic hinge at the joint between the convex face and the body of the cap, and a thin wall situated in the extension of the straight wall, beneath the hinge, capable of rolling and folding up on itself for each closing, with the aid of fold-initiating lines arranged parallel to the hinge above each other; these initiating lines meet, on the lateral faces, a common axis situated beneath the hinge.

Such a solution, which is very specific to pouring caps, may not be extrapolated or applied to the containers envisaged by the present invention, and more particularly to their pouring tubes, for several reasons.

Given the size of a pouring tube, as compared to a simple pouring spout, it is impossible to envisage using a thinner wall at the level of the pivoting means, which would make the pouring spout brittle relative to the repeated stresses to which the user subjects it.

Such a pouring spout in any case supposes the use of intrinsically pliable or flexible thermoplastic materials and excludes the use of relatively rigid materials such as those which are desired for containers with relatively large dimensions.

Lastly, the rolling of the thin wall up on itself each time the pouring spout is closed gives rise to active friction of the plastic on itself, and therefore to wear of the latter. A break in the plastic material, and therefore unrepairable damage to the pivoting means, may thus result rapidly Although this may be acceptable for a container of the disposable type, having the pouring spout in question, this is less readily acceptable for a container such as that envisaged by the present invention.

SUMMARY OF THE INVENTION

The subject of the present invention is a pivoting means which firstly provides, when used, a relatively "neutral" position of the pouring tube, in other words without any particular residual stress, which secondly is compatible with a relatively rigid plastic and which thirdly excludes any rolling or folding of the plastic upon itself.

According to the present invention, at the level of the pivoting means, the pouring tube has a substantially quadrilateral cross-section, for example a rectangle or a square, so as to define two substantially straight, facing lateral walls. Two identical pyramids, recessed towards the inside of the tube, are obtained or made by molding on the two lateral walls, respectively, and are situated at the same level, corresponding with each other. In terms of geometry, each pyramid has a base in the form of a triangle, for example an isosceles triangle, which is recessed and extends along a said lateral face from the inner side of the fold to the outer side of the fold. This isosceles triangle also has a base extending along the inner edge separating the lateral face in question and the adjacent inner face of the tube, and an opposite vertex situated on the outer edge separating that lateral face and the outer adjacent face of the tube.

As will be shown in the description given below, such a pivoting means permits folding about a virtual hinge consisting on the outer side of a line joining the two vertices of the two triangles, and on the inner side of the line passing through two opposite points, for example mid points situated on the two bases of the same triangles. For each recessed pyramid, this pivoting takes place with the inner faces of that pyramid folding flat against each other in pairs on either side of the common edge passing through the vertex of the triangle forming the base. The folds thus obtained, corresponding to the inner faces of the pyramids, are arranged and as it were retracted in the housing created by the break in the inner volume of the tube folded up on itself.

In sum, according to the invention, an articulation or pivoting is obtained by folding or arranging flat against each other various outer and inner surfaces of the tube.

BRIEF DESCRIPTION OF THE DRAWINGS

The present invention is now described with reference to the attached drawings, in which.

DESCRIPTION OF PREFERRED EMBODIMENTS

Figure 1:
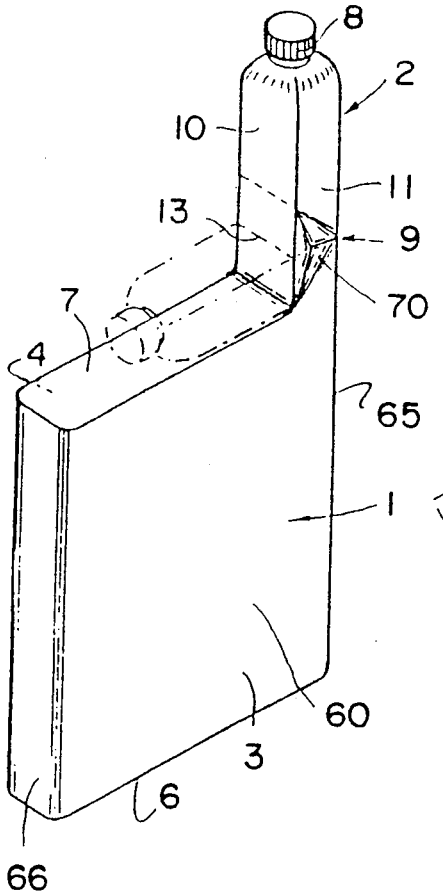
FIG. 1 shows a perspective view of a container according to the invention.

According to the invention, a container 1 is made in a single piece from a relatively rigid and thick thermoplastic material so as to resist the various strains or stresses it undergoes when used. This is composed of two parts which are interconnected, in other words without any discontinuity of material. These parts are, on the one hand, a hollow storing body with a general parallelepipedal shape and having a front wall 65, a rear wall 66, two lateral walls 3 and 4, a bottom wall 6 and a top wall 7; and, on the other hand, a pouring tube 2 having, in a general manner, the shape of a tube and having an opening sealed by a cap 8 at its upper end.

Figure 2:
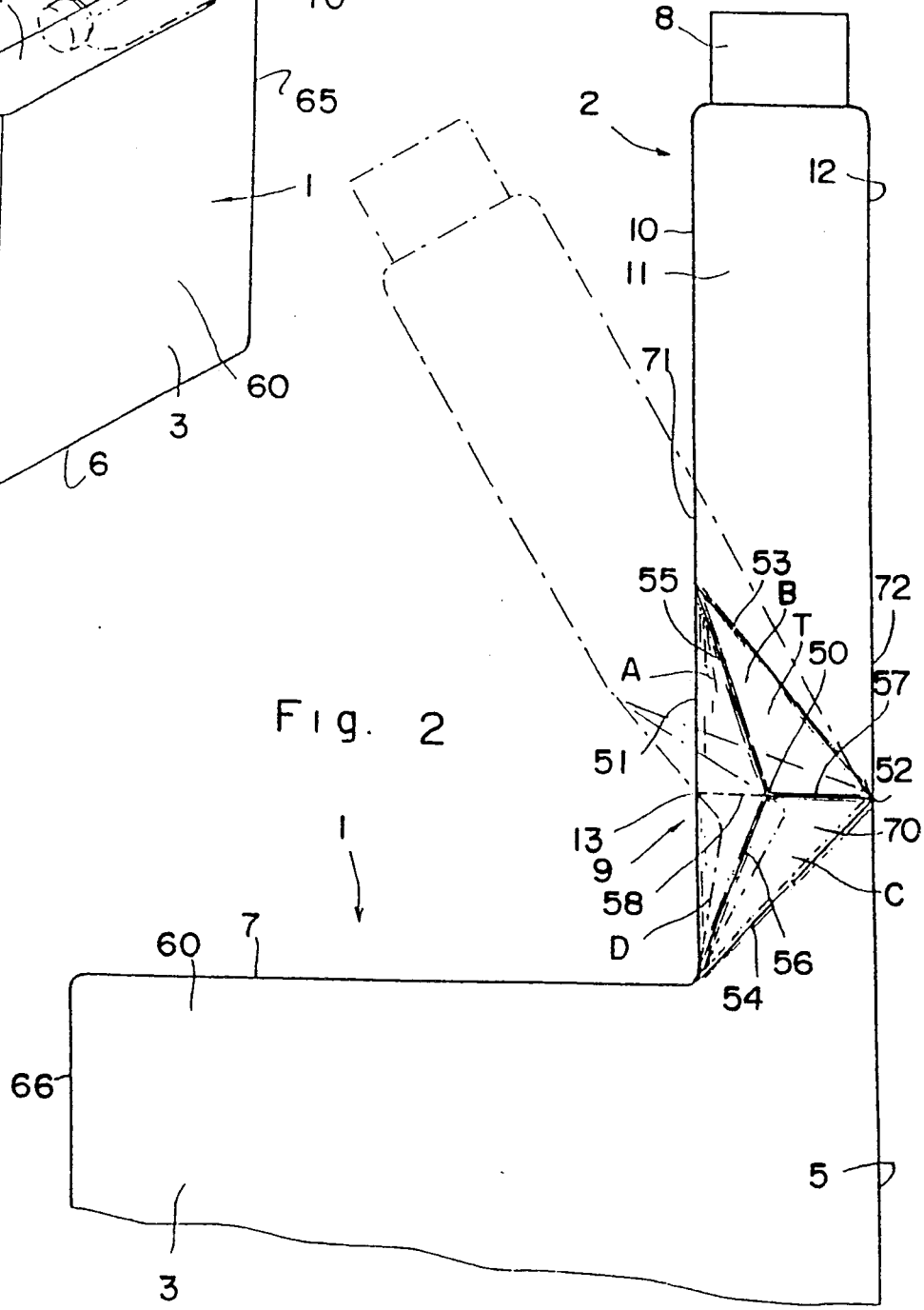
FIG. 2 shows a partial view in lateral elevation, showing in solid lines the pouring tube in its use or molding position and in dot-dash lines the pouring tube in the course of being bent towards its stored position.
Figure 3:
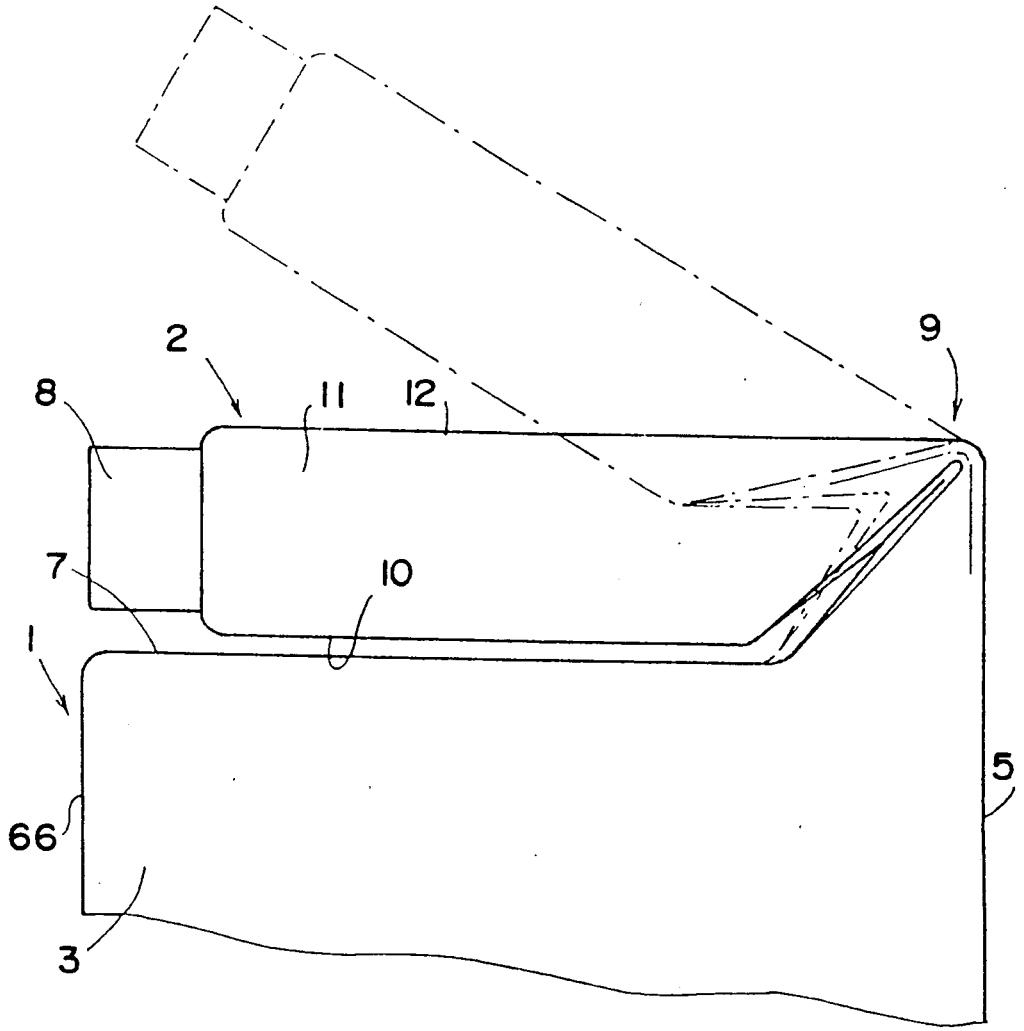
FIG. 3 shows in a similar manner to FIG. 2 the pouring tube in its stored position, represented by solid lines, from an intermediate position represented in both lines.

As emerges from FIGS. 2 and 3, this pouring tube 2 is capable of pivoting by way of the means 9 described herein above between a stored position (c.f. FIG. 3) in which it is folded down against the top wall 7 of the hollow body 60, and a use position (c.f. FIG. 2), corresponding to the molding position, in which it is raised angularly by approximately 90° relative to the stored position or relative to the top wall 7.

As shown more particularly in FIG. 2, in conjunction with FIG. 1, the pivoting means 9 is obtained by the formation of a certain number of fold lines when the container is molded. To be more precise, the pivoting means results from a combination of the following features.

At the level of the pivoting hinge 9, the pouring tube 2, has, in cross-section, a quadrilateral shape, for example a square or a rectangle. This shape defines two substantially straight facing lateral walls 11 separated by an adjacent wall 10 turned towards the inside of the pivoting travel, and a wall 12 turned towards the outside of the abovementioned travel The two lateral walls 11 are coplanar with the two lateral walls 3 and 4 of the hollow body 60. The outer wall 12 of the pouring tube 2 extends the front wall 5 of the same hollow body 60.

Two recessed pyramids 70 are turned towards the inside of the tube 2 and arranged on the two lateral walls 11, respectively. These two pyramids may be obtained by relief molding and then be turned back towards the inside of the tube 2 by pressing on the vertex of the pyramids. As shown in FIG. 2, each pyramid 70 has a recessed triangular base "T", a vertex 50 situated inside the tube 2, and four faces A, B, C, D, each connecting the vertex 50 and the triangular base "T".

As shown in FIG. 2, the triangular base "T" of each pyramid 70 extends over the lateral face 11 in question from the inner face or side 10 to the outer face or side 12. Each isosceles triangle "T" has a base 51 arranged along the inner edge 71 separating the lateral face 11 from the adjacent inner face 10 of the tube, and an opposite vertex 52 situated on the outer edge 72 separating the same lateral face and the outer adjacent face 12 of the tube 2.

Moreover, as shown in FIG. 1, the two recessed pyramids 70 belonging to the two lateral faces 11 of the tube 2 are situated at the same level, coinciding or corresponding with each other. Furthermore, the inner face 10 of the tube 2, extending between the two lateral faces, has a fold line 13 connecting the two mid points of the two bases 51 of the two isosceles triangles 70, respectively.

As a result of the design described above, the pivoting means 9 has the following fold lines:

(a) a first outer line, which has not been shown connecting the two vertices 52 of the two triangles "T";

(b) inner line 13 parallel to and situated at the same level as the first outer line;

(c) two inner lines 55, each separating the faces A and B of the pyramid 70;

(d) two inner lines 56, each separating the faces C and D of the pyramid 70;

(e) two inner lines 57, each separating the faces B and C of the pyramid 70; and (f) two bend lines, shown in dot-dash lines, with the reference 58, each connecting a mid point of the base 51 and the vertex 50 of the corresponding pyramid 70; these two lines are not, however, premolded like the others.

In order to pivot the pouring tube 2 from its use position, shown in solid lines in FIG. 2, into its stored position, shown in solid lines in FIG. 3, slight pressure need only be applied to the outer wall 12 of the tube 2 in the region of the pivoting means 9 and then in the direction of the top wall 7 of the hollow body 60. This movement unlocks the tube 2 from its use position and then brings it into a horizontal position, by rotation from the right-hand side of the drawing to the left-hand side, passing through various intermediate positions shown in dot-dash lines in FIGS. 2 and 3.

During this movement, the following folds are obtained successively or simultaneously;

(a) the wall or outer face 12 of the tube 2 folds about the line connecting the vertices 52 of the triangles "T";

(b) the inner wall 10 folds about the line 13;

(c) the faces A and B fold against each other, inside the tube 2, about the fold lines 55;

(d) the faces C and D fold against each other, inside the tube 2, about the fold lines 56;

(e) the faces A and B, folded together, and the faces C and D, folded together, then fold against each other, about the fold lines 57, still inside the tube 2; in the same movement, the faces A of the pyramids 70 bend about the lines 51.

In sum, as shown in FIG. 3, those zones of the inner face 10 of the tube 2 situated on either side of the fold line 13 are flat against each other, the pyramids 70 folded up on themselves being contained in the break in the internal volume of the tube 2.

Reversible fastening means may be provided, for example "clip-fastening" means, which have not been shown, in order to fix the tube 2 in the stored position.

I claim:

1. A container comprising:

a hollow storing body and a pouring tube connected to said hollow storing body;

said pouring tube comprising a pivoting section with a substantially quadrilateral cross-section defining two substantially straight opposing lateral walls connected by a first wall and a second wall respectively along a first edge and a second edge of each said lateral wall;

each said lateral wall comprising a substantially identical pyramid shaped recess extending toward each other, said pyramids defining fold lines of said pivoting section on said pouring tube.

2. A container according to claim 1, wherein each said pyramid has a base in the shape of a triangle substantially coplanar with its respective lateral wall, each said triangle having a base extending along said first edge and a vertex located on said second edge.

3. A container according to claim 2, wherein each said triangle is an isosceles triangle.

4. A container according to claim 3, wherein said first wall contains a fold line connecting midpoints of said bases of said isosceles triangles.

5. A container according to claim 1, said container being molded from a thermoplastic material.

6. A container according to claim 5, said container being molded with said pivoting section in an unfolded state.

7. A container according to claim 1, wherein said pivoting section permits a first section of said pouring tube to be moved angularly about 90° relative to a second section of said pouring tube.

8. The container of claim 1 wherein said identical pyramid shaped recesses extend towards each other at substantially the same level.

9. A container molded as a single piece from a thermoplastic material, comprising:

a hollow storing body having a top wall;

a pouring tube connected to said hollow storing body and comprising a pivoting section whereby at least a portion of said pouring tube is folded down against said top wall in a stored position and raised angularly by about 90° relative to said top wall in a use position when corresponds to a position in which said container is molded;

said pivoting section having a substantially quadrilateral cross-section defining two substantially straight opposing lateral walls connected by a first wall and a second wall respectively along a first edge and a second edge of each said lateral wall;

each said lateral wall comprising a substantially identical molded pyramid shaped recess extending toward each other, said pyramid having a base in the shape of a triangle substantially coplanar with its respective lateral wall, each said triangle having a base extending along said first edge and a vertex located on said second edge.

10. A container according to claim 9, wherein each said triangle is an isosceles triangle and said first wall contains a fold line connecting midpoints of said bases of said isosceles triangles.

11. A container according to claim 9, wherein said lateral walls are substantially coplanar with corresponding side walls of said hollow storing body.

12. A container according to claim 9, wherein said second wall is substantially coplanar with a front wall of said hollow storing body.

13. A container according to claim 9, wherein:

said lateral walls are substantially coplanar with corresponding side walls of said hollow storing body;

an unfolded portion of said first wall is substantially parallel to said top wall of said hollow storing body in said stored position; and said pouring tube does not extend beyond a rear wall of said hollow storing body in said stored position.

14. The container of claim 9 wherein said identical pyramid shaped recesses extend towards each other at substantially the same level.

* * * * *